US010890118B2

(12) United States Patent
Miura

(10) Patent No.: US 10,890,118 B2
(45) Date of Patent: Jan. 12, 2021

(54) EXHAUST CONTROL VALVE OF SADDLE-RIDING VEHICLE

(71) Applicant: HONDA MOTOR CO., LTD., Tokyo (JP)

(72) Inventor: Katsuki Miura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/540,828

(22) Filed: Aug. 14, 2019

(65) Prior Publication Data

US 2020/0063664 A1 Feb. 27, 2020

(30) Foreign Application Priority Data

Aug. 24, 2018 (JP) ..... 2018-157503

(51) Int. Cl.
*F02D 9/04* (2006.01)
*F02D 9/10* (2006.01)
*F01N 1/16* (2006.01)

(52) U.S. Cl.
CPC ..... *F02D 9/1045* (2013.01); *F01N 1/166* (2013.01); *F02D 9/04* (2013.01); *F02D 9/1065* (2013.01)

(58) Field of Classification Search
CPC ..... F01N 9/165; F01N 9/166; F01N 13/087; F01N 2240/36; F01N 2260/14; F01N 2590/04; F02D 9/04; F02D 9/1045; F02D 9/1065
USPC ..... 60/312, 323, 324
See application file for complete search history.

(56) References Cited

U.S. PATENT DOCUMENTS 2,993,513 A * 7/1961 Hyde ..... B64D 33/02 137/625.11
3,592,221 A * 7/1971 Worley ..... F16K 11/052 137/375
3,690,341 A * 9/1972 Sutko ..... F15D 1/001 137/101
4,585,023 A * 4/1986 Almada ..... B08B 9/00 134/166 C
5,165,450 A * 11/1992 Marrelli ..... F16K 11/052 137/118.01
5,899,805 A * 5/1999 Dowd ..... B64D 13/00 137/875

(Continued)

FOREIGN PATENT DOCUMENTS

JP 2008-169797 A 7/2008

*Primary Examiner* — Audrey K Bradley
*Assistant Examiner* — Dapinder Singh
(74) *Attorney, Agent, or Firm* — Birch, Stewart, Kolasch & Birch, LLP

(57) ABSTRACT

An engine exhaust control valve of a saddle-riding vehicle is provided with: a valve shaft disposed in an intersecting manner with a center line of a main pipe portion of an engine exhaust pipe; a valve plate mounted on the valve shaft and rotatably positioned within an inner peripheral surface of the main pipe portion; a valve rotational drive portion mounted on one shaft end of the valve shaft; a drive motor for driving the valve rotational drive portion; and a control unit for controlling the drive motor. Protruding portions with which outer peripheral edges of the valve plate are brought into contact at a rotational limit of the valve plate in a closing direction are formed on an inner peripheral surface of the main pipe portion. The above structure provides a high degree of sealing.

9 Claims, 10 Drawing Sheets

(56) References Cited

U.S. PATENT DOCUMENTS

| | | | | |
|---|---|---|---|---|
| 5,908,047 | A * | 6/1999 | Nakamura | F01N 3/027 137/875 |
| 6,182,699 | B1 * | 2/2001 | Hawkes | F16K 11/052 137/861 |
| 6,273,119 | B1 * | 8/2001 | Foster | F02D 9/04 137/15.25 |
| 6,698,717 | B1 * | 3/2004 | Brookshire | F02D 9/1045 251/305 |
| 6,955,188 | B2 * | 10/2005 | Heckt | F01N 3/031 137/87.01 |
| 8,109,084 | B2 * | 2/2012 | Morita | F01N 13/009 60/324 |
| 9,587,565 | B2 * | 3/2017 | Streutker | F02D 9/04 |
| 2008/0168767 | A1 | 7/2008 | Kanzawa et al. | |

* cited by examiner

EXHAUST CONTROL VALVE OF SADDLE-RIDING VEHICLE

TECHNICAL FIELD

The present invention relates to an exhaust control valve at a branching portion of an engine exhaust pipe on a saddle-riding vehicle.

BACKGROUND ART

With respect to a saddle-riding vehicle, an exhaust control valve which controls flow of engine exhaust gas at a branching portion of an exhaust pipe is described in Patent Document 1 mentioned below, for example. In the exhaust control valve described in Patent Document 1, an excessively large gap exists between the valve and the inside of the exhaust pipe, and, hence, even when the valve is at a closed position, the exhaust gas passes through the gap. Accordingly, there is a concern that the degree of sealing by the valve is low.

On the other hand, in a case where exhaust pipes are branched at an upstream side of an exhaust muffler and the exhaust pipes are led into the exhaust muffler, when sealing is performed with respect to one branched exhaust pipe, there occurs a case where the exhaust control valve is required to exhibit high degree of sealing.

PRIOR ART DOCUMENT

[Patent Document]

[Patent Document 1] JP 2008-169797 A (FIGS. 1 to 5 and FIG. 11)

SUMMARY OF INVENTION

Underlying Problem to be Solved by the Invention

The present invention has been made in view of the above-stated prior art, and it is an object of the present invention to provide an exhaust control valve disposed at a branching portion of an engine exhaust pipe assembly of a saddle-riding vehicle which can acquire high degree of sealing.

Means to Solve the Underlying Problem

To overcome the above-mentioned drawbacks, the present invention provides an exhaust control valve of a saddle-riding vehicle in which an engine exhaust pipe of the saddle-riding vehicle has a main pipe portion and a branch pipe portion which are connected to an exhaust muffler at a downstream side, and a branching portion, where the branch pipe portion is branched sideward from the main pipe portion, is provided to perform a full-open to full-closed control of the main pipe portion located at a downstream side of the branching portion; wherein the exhaust control valve includes: a valve shaft disposed in the main pipe portion, at a position facing a branch opening of the branch pipe portion, to extend in a manner intersecting a center axis of the main pipe portion; a valve plate mounted on the valve shaft to be rotatable about the valve shaft in and along an inner peripheral surface of the main pipe portion; a valve rotational drive portion mounted on one end of the valve shaft, penetrating the inner peripheral surface of the main pipe portion; a drive motor for driving the valve rotational drive portion; and a control unit for controlling the drive motor; and protruding portions are provided on an inner peripheral surface of the main pipe portion, the protruding portions being formed so as to be brought into contact with outer peripheral edges of the valve plate at a rotational limit of the valve plate of the exhaust control valve in a closing direction.

According to the exhaust control valve of a saddle-riding vehicle of the present invention, at the time of fully closing the main pipe portion at a downstream side of the branch portion of the exhaust pipe by performing a full-open to full-closed control of the main pipe portion, the protruding portions formed on the inner peripheral surface of the main pipe portion and the outer peripheral edge of the valve plate are brought into contact with each other, and hence sealing property of the exhaust control valve can be improved.

According to a preferred embodiment of the present invention, the protruding portions have respective cutout portions in areas around the valve shaft.

According to the above feature, it is possible to avoid interference between the protruding portions and the valve shaft caused by thermal expansion.

According to a further preferred embodiment of the present invention, the protruding portions include an upstream-side protruding portion formed so as to be disposed adjacent to a downstream-side edge of the branch opening of the branch pipe portion, the valve plate has a downstream-side valve plate section directed, in a fully-open state, in a downstream direction of the center line of the main pipe portion with respect to the valve shaft, and the valve plate is rotatable from a downstream side of the center axis into a fully-closed state, where the downstream-side valve plate is in contact with the upstream-side protruding portion at a valve angle of less than 90°.

According to the above features, in a fully-closed state, the downstream-side valve plate section which is rotated from the fully-open state is brought into contact with the upstream-side protruding portion adjacent to the downstream-side edge of the branch opening from a downstream side of the main pipe portion, and the upstream-side valve plate section is also brought into contact with the downstream-side protruding portion. As a result, the main pipe portion can be brought into a fully-closed state with the valve plate set to a valve angle of less than 90° from the downstream side of the center axis of the main pipe portion, and hence exhaust gas flowing from the upstream side of the main pipe portion can be introduced by the valve plate into the branch pipe portion at a branch angle which forms an obtuse angle with respect to the center axis of the main pipe portion, whereby exhaust gas flow resistance at the branching portion can be suppressed.

According to a further preferred embodiment of the present invention, in a state where the outer peripheral edges of the valve plate are brought into contact with the protruding portions, the control unit of the drive motor for driving the valve rotational drive portion is configured to hold a motor duty ratio in which a predetermined holding drive force is generated in a direction in which the exhaust control valve is closed.

According to this feature, a state where the outer peripheral edges of the valve plate are brought into contact with the protruding portions with a certain holding drive force is maintained, and hence the fully-closed state of the exhaust control valve can be maintained with certainty.

According to the preferred embodiment of the present invention, a full closing detection range is provided in connection with an actual motor rotational angle in the fully-closed state of the valve plate of the exhaust control valve, and the control unit is configured to change the motor duty ratio so as to change a drive force of the exhaust control valve to the predetermined holding drive force in a case where the motor actual rotational angle is not shifted even when the motor duty ratio of a predetermined value or more is generated in driving the valve plate within the full closing detection range.

According to the above feature, a fully-closed state is determined only within the full closing detection range corresponding to the motor actual rotational angle in a fully-closed state, and it is hence possible to avoid erroneous determination where biting of a foreign substance in the other region and so on is determined as a fully-closed state.

According to a preferred embodiment of the present invention, the actual motor rotational angle on a valve full open side of the full closed detection range is set as a locking detection range, and the control unit is configured to stop driving of the exhaust control valve in a case where the actual motor rotational angle is not shifted even when an increase of the motor duty ratio of a predetermined value or more is generated in driving the valve plate within the lock detection range.

According to the above feature, when an actual motor rotational angle is not shifted even when a motor duty ratio of a predetermined value or more is generated within the lock detection range in the midst of closing the exhaust control valve, it is determined that abnormality which is the biting of a foreign substance such as a stone has occurred, and driving of the exhaust control valve can be stopped, and hence the drive motor or the like can be protected.

Advantageous Effects of Invention

According to the exhaust control valve of a saddle-riding vehicle of the present invention, at the time of fully closing the main pipe portion at a downstream of the branching portion of the exhaust pipe by performing a full-open to full-closed control of the main pipe portion, the protruding portions formed on the inner peripheral surface of the main pipe portion and the outer peripheral edges of the valve plate are brought into contact with each other, and hence sealing property of the exhaust control valve can be improved.

MODE FOR CARRYING OUT THE INVENTION

Figure 1:
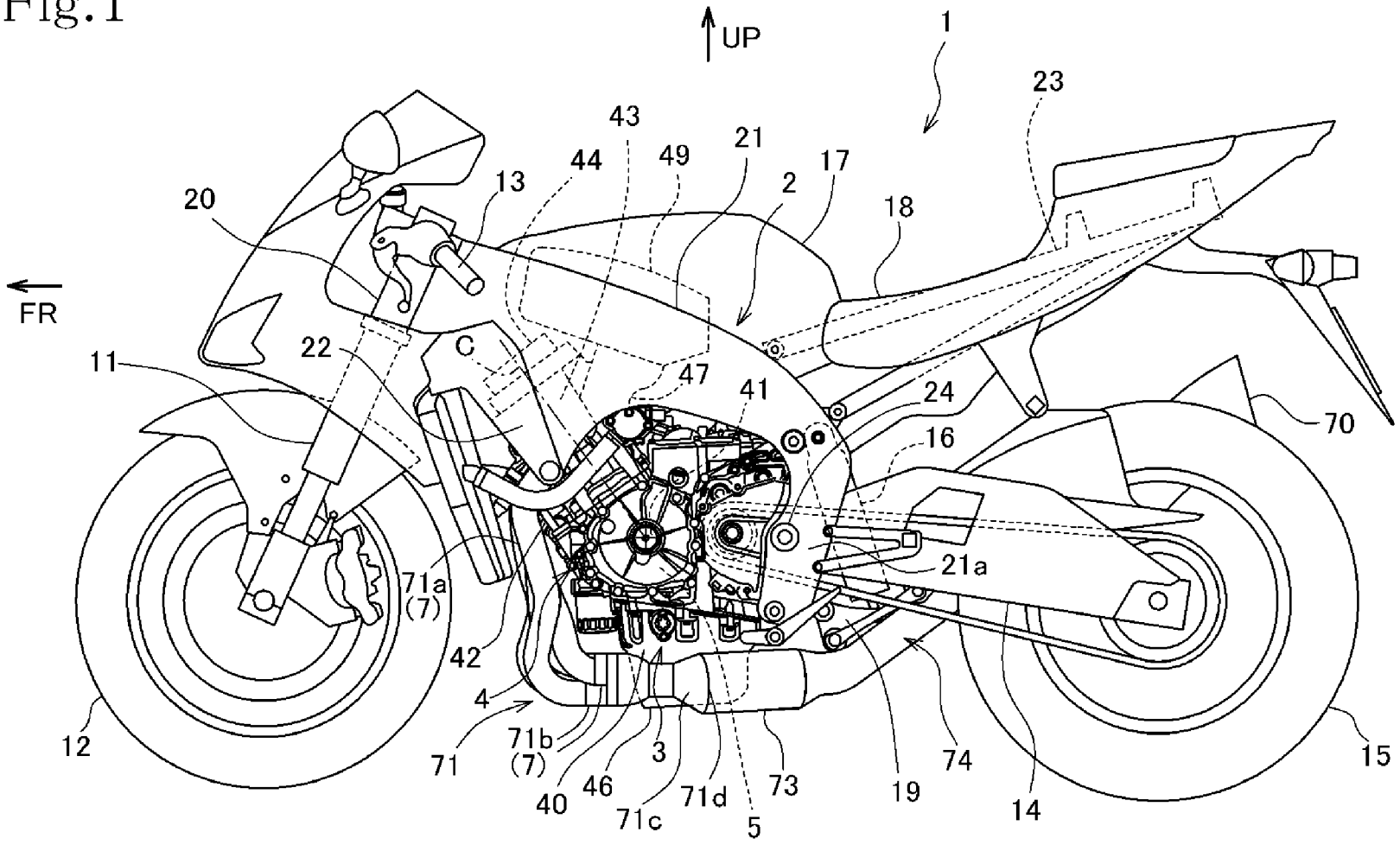
FIG. 1 is left side view of a motorcycle with an exhaust control valve according to an embodiment of the invention.

With reference to the drawings, an exhaust control valve of a saddle-riding vehicle according to one embodiment of the present invention will be described.

In the description of this specification, directions of front and rear, left and right, and up and down are directions of a saddle-riding vehicle on which an engine exhaust pipe of a saddle-riding vehicle according to this embodiment is mounted. In this embodiment, the saddle-riding vehicle is a two-wheel motorcycle.

In the drawings, an arrow FR indicates a frontward direction of a vehicle, an arrow LH indicates a leftward direction of the vehicle, an arrow RH indicates a rightward direction of the vehicle, and an arrow UP indicates an upward direction of the vehicle.

FIG. 1 is a left side view of a two-wheel motorcycle 1 on which the exhaust control valve of a saddle-riding vehicle according to this embodiment is mounted.

As shown in FIG. 1, a body frame 2 of the motorcycle 1 is formed such that main frames 21 divided leftward and rightward from a head pipe 20 extend rearward, and center frame portions 21*a* are bent downward from rear portions of the main frames 21.

Down frames 22 extend in obliquely rearward and downward directions from the head pipe 20.

Seat rails 23 extend obliquely in a rearward and upward direction from portions of the main frames 21 in front of upper bent portions of the center frame portions 21*a*.

A front wheel 12 is rotatably supported on lower ends of a front fork 11 which is steerably supported by the head pipe 20, and a handlebar 13 is connected to the front fork 11 by way of an upwardly extending steering shaft (not shown in the figure).

A swing arm 14 whose front end is pivotally supported on a pivot shaft 24 extends rearward from the center frame portions 21*a*, and a rear wheel 15 is rotatably supported on a rear end of the swing arm 14 in a vertically swingable manner.

A rear suspension link 19 is disposed between a lower edge of the swing arm 14 and lower end portions of the center frame portions 21*a*. A rear suspension 16 is interposed between a part of the rear suspension link 19 and upper portions of the center frame portions 21*a*.

A power unit 3 including an internal combustion engine 4 is mounted on the motorcycle 1 in a state where the power unit 3 is fixed to the body frame 2. The power unit 3 is configured such that a transmission 5 is housed in a crankcase 40 of the internal combustion engine 4 integrally with the internal combustion engine 4. The power unit 3 is suspended from the down frames 22 disposed on the front side of the main frames 21. The internal combustion engine 4 is a water-cooled, serial 4-cylinder, 4-stroke cycle internal combustion engine where four cylinders are arranged in a vehicle width direction, and a crankshaft 41 of the internal combustion engine 4 is directed in the vehicle width direction (lateral direction).

Above the power unit 3, a fuel tank 17 is mounted on the main frames 21 in a bridging manner. A seat 18 is disposed behind the fuel tank 17, and the seat 18 is supported by the seat rails 23.

Figure 2:
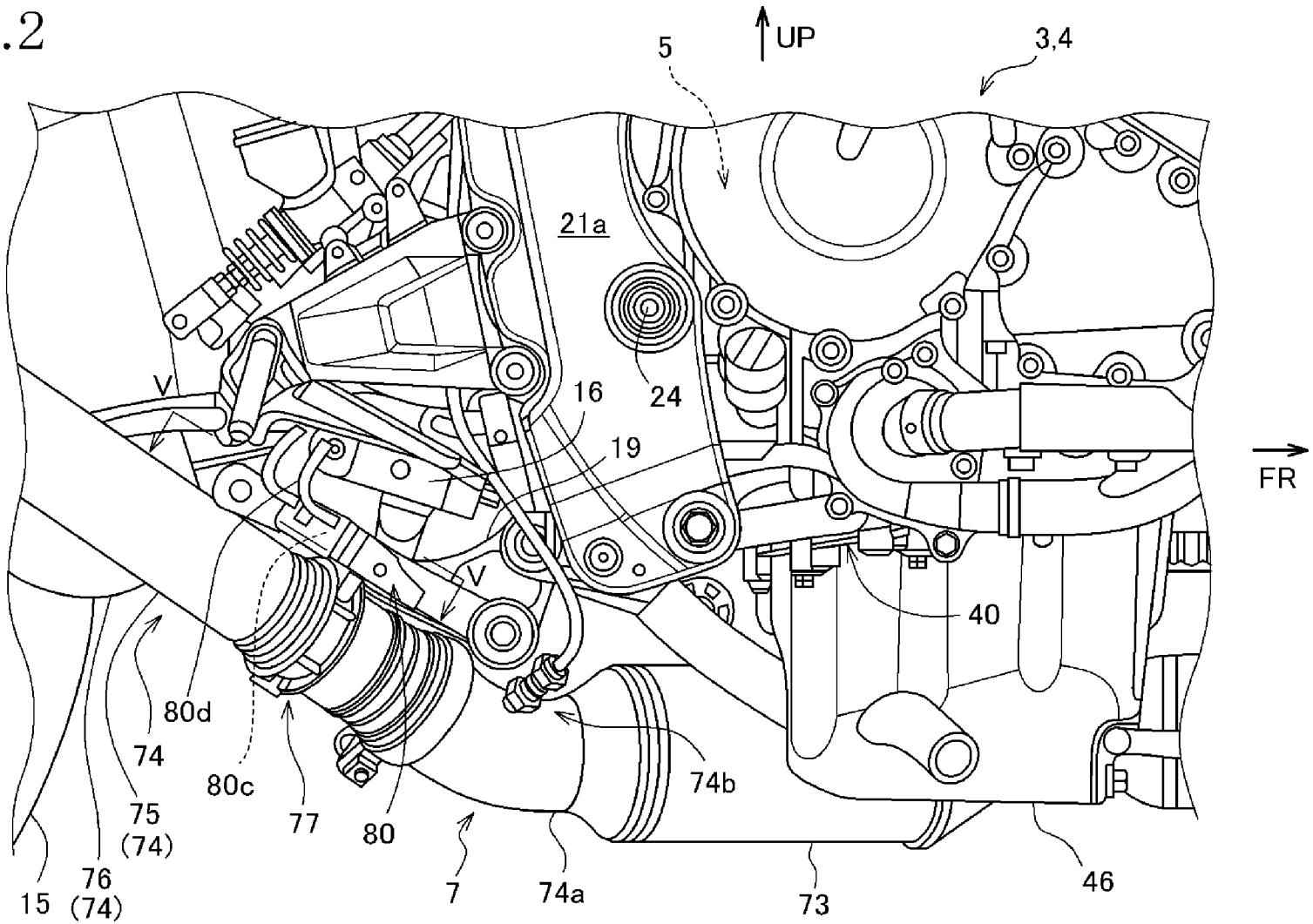
FIG. 2 is a right side view showing a right side surface of a lower portion of a power unit and an engine exhaust pipe of the motorcycle shown in FIG. 1.
Figure 3:
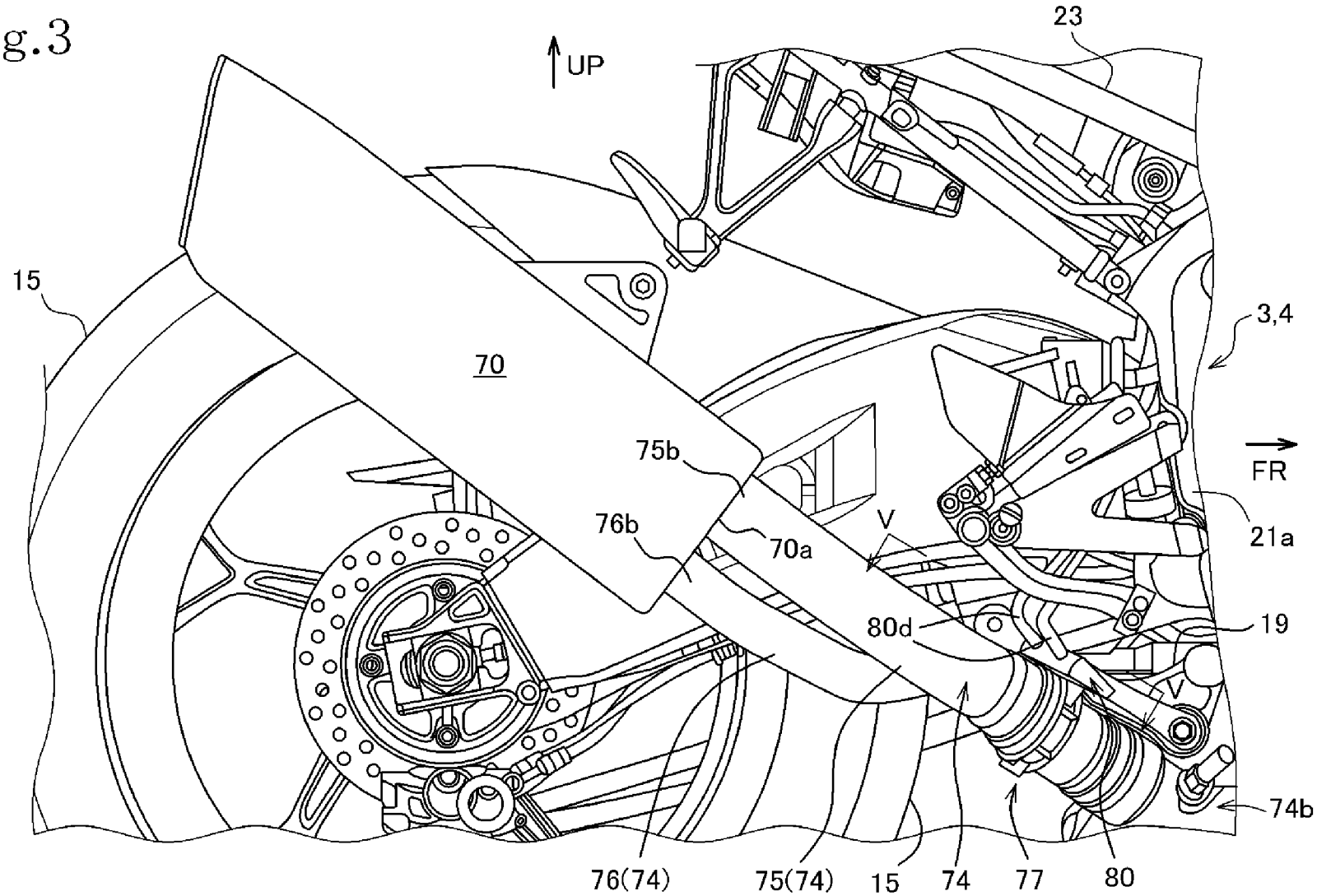
FIG. 3 is a right side view showing a right side surface of an area from a lower portion of the power unit to a rear wheel, the exhaust pipe, and an exhaust muffler of the motorcycle, succeeding to the structure shown in FIG. 2.

FIG. 2 shows a right side surface of a lower portion of the power unit 3 and an engine exhaust pipe 7 of the motorcycle 1, and FIG. 3 shows a right side surface ranging from a lower portion of the power unit 3 to the rear wheel 15, the exhaust pipe 7 and an engine exhaust muffler 70 of the motorcycle 1. FIG. 3 shows a configuration rearwardly succeeding to the configuration shown in FIG. 2.

With reference to FIG. 1, a cylinder block 42 and a cylinder head 43 are joined to an upper portion of the crankcase 40, which rotatably supports the crankshaft 41, in such a manner that the cylinder block 42 and the cylinder head 43 are sequentially stacked on the crankcase 40 in a standing posture with a cylinder axis C slightly inclined frontward. The cylinder head 43 is covered by a cylinder head cover 44 from above.

An oil pan 46 is mounted on a lower portion of the crankcase 40.

An engine intake pipe 47 extends upward from a rear portion of the forwardly-inclined cylinder head 43 of the internal combustion engine 4, and is connected to an air cleaner 49 by way of a throttle body not shown in the drawings.

The exhaust pipe 7 extends downward from a front portion of the cylinder head 43, passes a right side of a lower portion of the crankcase 40, extends obliquely upward on a right side of the rear wheel 15, and is connected to the exhaust muffler 70.

As illustrated in FIG. 1, the exhaust pipe 7 used in this embodiment includes: an upstream-side exhaust pipe assembly 71 which is formed of four primary exhaust pipes 71*a* having upstream ends thereof connected to four exhaust ports formed on a side surface of a front portion of the cylinder head 43 for discharging exhaust gas; unit exhaust pipes 71*b* formed by merging the four primary exhaust pipes 71*a* on a downstream side such that each unit exhaust pipe 71*b* is connected to two of the primary exhaust pipes 71*a*; one exhaust pipe merging portion 71*c* which is connected to the two unit exhaust pipes 71*b* in common; a catalyst built-in pipe 73 which is continuously connected to a downstream end 71*d* of the exhaust pipe merging portion 71*c* in a direction of extension of the downstream end 71*d* and is disposed below the internal combustion engine 4 in a rearwardly extending manner; and a downstream-side exhaust pipe 74 having an upstream end which is connected to the catalyst built-in pipe 73. The downstream-side exhaust pipe 74 extends obliquely upward on a right side of the vehicle body, and has a downstream end which is connected to the exhaust muffler 70.

As shown in FIGS. 2 and 3, the downstream-side exhaust pipe 74 has a main pipe portion 75 and a branch pipe portion 76 on a downstream side of an upstream end 74*a* of the downstream-side exhaust pipe 74, and has a branching portion 77 where the branch pipe portion 76 is branched from the main pipe portion 75.

In the branching portion 77, as viewed in a side view, the branch pipe portion 76 overlaps with a vehicle center side wall of the main pipe portion 75. Downstream ends 75*b* and 76*b* of both the main pipe portion 75 and the branch pipe portion 76 are respectively connected to an upstream end 70*a* of the exhaust muffler 70 disposed on a right side of the rear wheel 15.

In this embodiment, the main pipe portion 75 of the downstream-side exhaust pipe 74 has a structure which enables the main pipe portion 75 to cope with a condition when the internal combustion engine 4 is at a high-output time. This means that exhaust gas is made to flow in the main pipe portion 75 at the high-output time.

Figure 4:
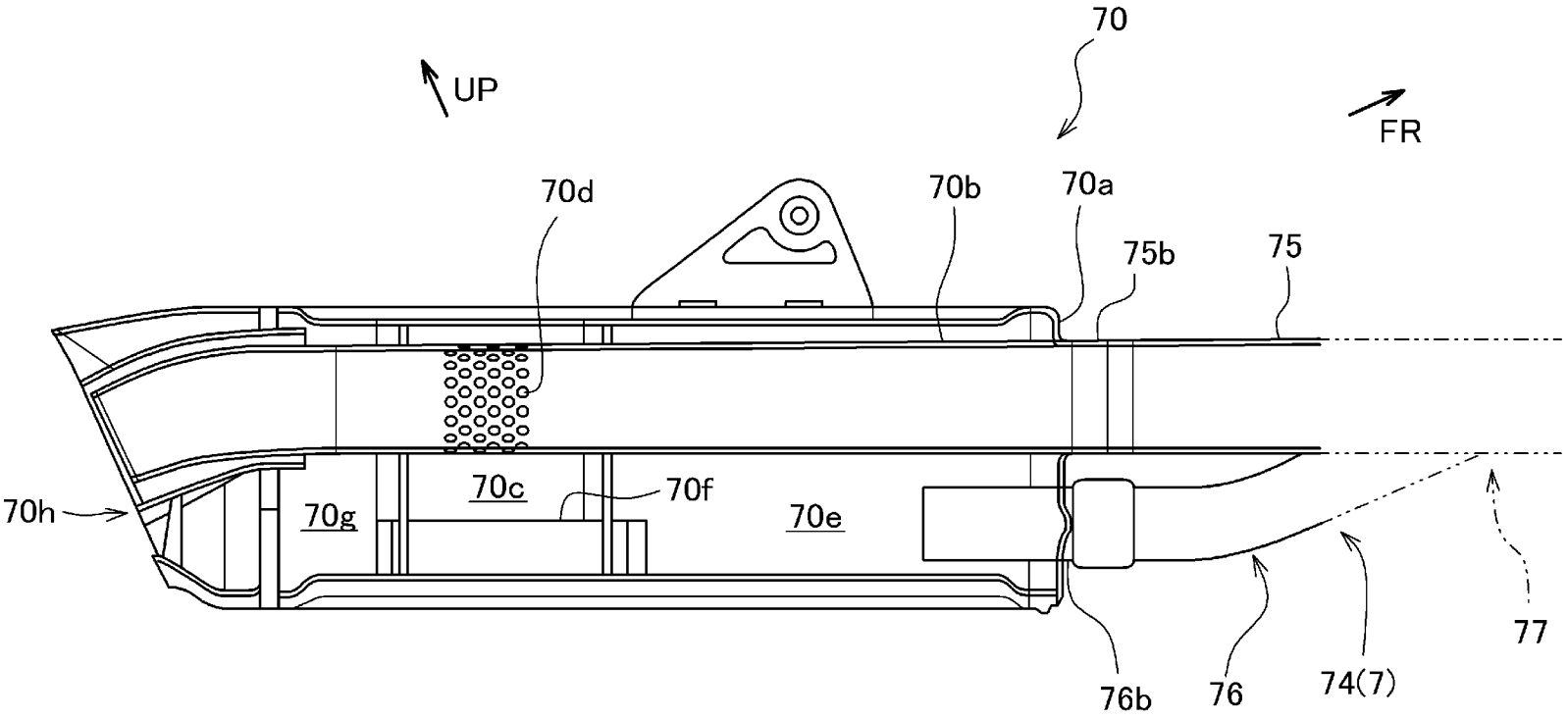
FIG. 4 is a right longitudinal sectional view of an exhaust muffler.

In the longitudinal section of the exhaust muffler 70 shown in FIG. 4, exhaust gas which is made to flow through the exhaust muffler 70 from the main pipe portion 75 passes through an inner-muffler main pipe portion 70*b* which is connected to the main pipe portion 75 in a straight-line shape. In the flow of exhaust gas through the inner-muffler main pipe portion 70*b*, the exhaust gas flows back and forth in a reciprocating manner between the interior of the inner-muffler main pipe portion 70*b* and a second chamber 70*c* surrounding the inner-muffler main pipe portion 70*b* through a porous portion 70*d* provided at an intermediate portion of the inner-muffler main pipe portion 70*b*, whereby a certain muffling effect can be obtained. On the other hand, the exhaust gas can be discharged smoothly without stagnation, thus enhancing the output of the internal combustion engine.

When output of the internal combustion engine 4 is at an intermediate level or at a low level, exhaust gas is made to flow in the branch pipe portion 76. In the exhaust muffler 70, the exhaust gas first flows and expands in a first chamber 70*e* and, thereafter, flows and expands again in a third chamber 70*g* through a communication pipe 70*f* which bypasses the second chamber 70*c*, thus acquiring a predetermined muffling effect, and is thereafter discharged from a rear end 70*h* of the exhaust muffler 70.

Figure 5:
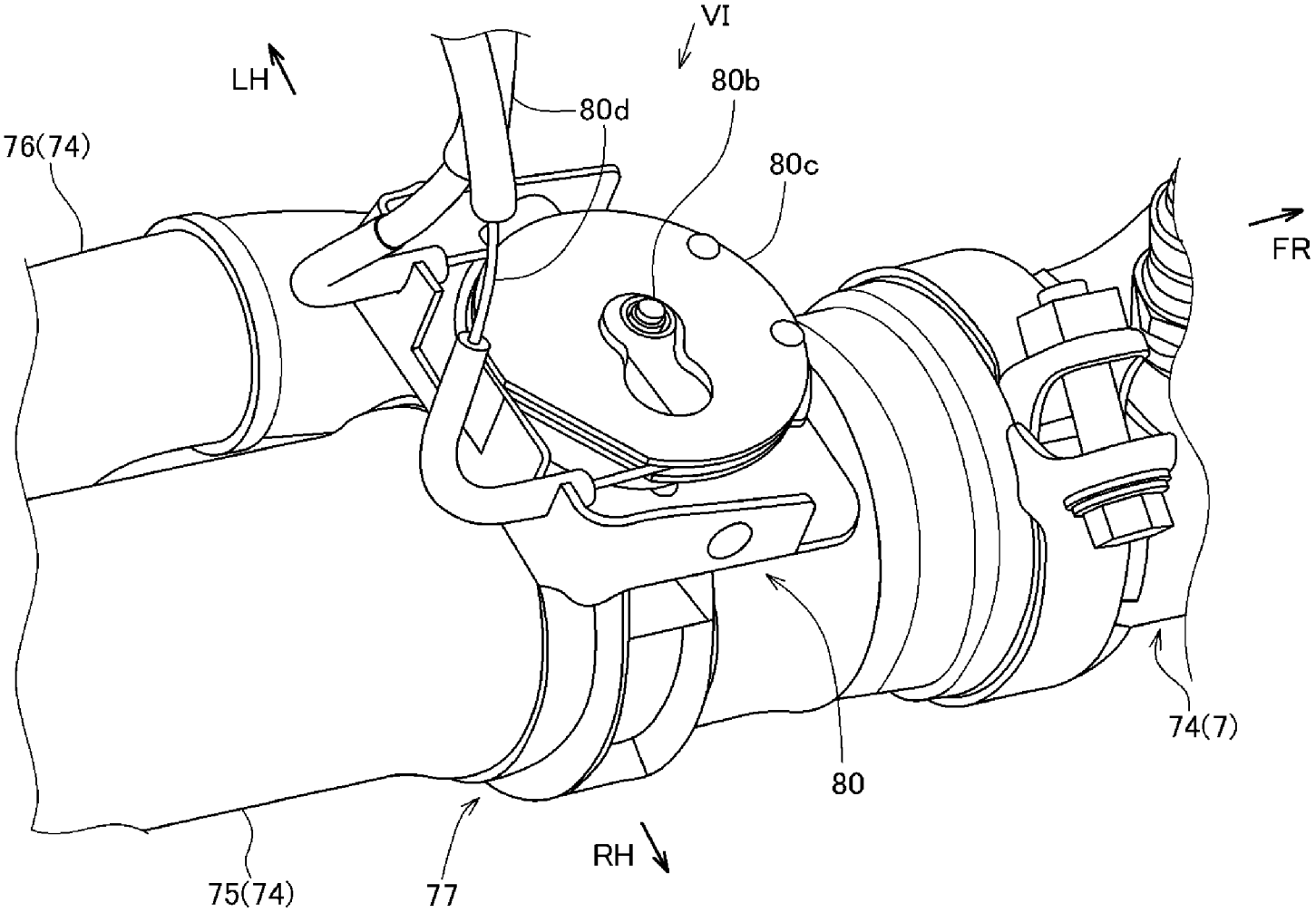
FIG. 5 is a perspective view of a branching portion of a downstream-side exhaust pipe, as viewed in a direction indicated by an arrow V-V in FIGS. 2 and 3.

Reference is made to FIG. 5, which is a perspective view of the branching portion 77, as viewed in a direction indicated by arrows V-V in FIGS. 2 and 3. To control the exhaust gas as above, an exhaust control valve 80 is provided to the branching portion 77 of the downstream-side exhaust pipe 74 where the branch pipe portion 76 is branched from the main pipe portion 75 on the downstream side of the upstream end 74*a* (see FIG. 2) of the downstream-side exhaust pipe 74.

Figure 6:
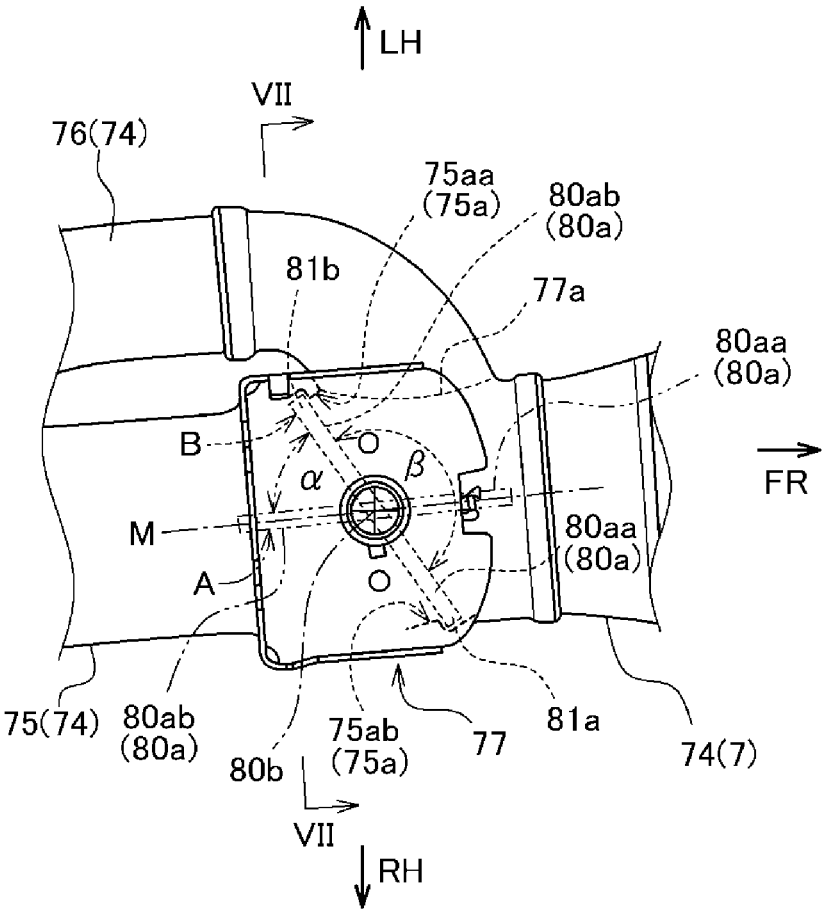
FIG. 6 is a plan view of the branching portion as viewed in a direction indicated by an arrow VI in FIG. 5.

As shown in FIG. 6, which is a plan view of the branching portion 77 as viewed in a direction indicated by an arrow VI in FIG. 5, the branch pipe portion 76 is branched from the main pipe portion 75 sideward at the branching portion 77. The exhaust control valve 80 is a butterfly valve where a valve plate 80*a* is disposed so as to be slidingly brought into contact with an inner peripheral surface 75*a* of the main pipe portion 75 of the branching portion 77.

The exhaust control valve 80 is controlled to be operated between a fully-closed state B where the valve plate 80*a* shuts off the flow of exhaust gas to the main pipe portion 75 and introduces all of the exhaust gas from an upstream side to the branch pipe portion 76 (in FIG. 6, the valve plate 80*a* is schematically illustrated by a broken line) and a fully-open state A where the valve plate 80*a* is positioned parallel to the direction of a center line M of the main pipe portion 75, thus introducing the exhaust gas to the main pipe portion 75 (in FIG. 6, the valve plate 80*a* is schematically illustrated by a double-dashed chain line).

In the fully-open state A, the flow of a part of the exhaust gas into the branch pipe portion 76 is not obstructed.

FIG. 5 shows a valve rotational drive portion 80*c* which is mounted on a valve shaft 80*b* of the exhaust control valve 80.

The valve rotational drive portion 80*c* is a driven pulley with which a drive wire 80*d* engages. The drive wire 80*d* is driven by a drive motor 91 (see FIG. 8) controlled by an engine control unit (ECU) 9 in accordance with an operating state of the internal combustion engine 4, and rotatingly drives the valve rotational drive portion 80*c*, thus controlling the rotational position of the valve plate 80*a* of the exhaust control valve 80, as will be noted from FIGS. 5 and 6.

In this manner, the exhaust control valve 80 is provided to the branching portion 77 of the downstream-side exhaust pipe 74. Accordingly, by operating the exhaust control valve 80, it is possible to change and control the flow of exhaust gas which passes through the main pipe portion 75 and the branch pipe portion 76 to flow into the exhaust muffler 70.

As shown in FIGS. 2 and 3, the downstream-side exhaust pipe 74 is inclined from the branching portion 77 in such a manner that a rear side of the downstream-side exhaust pipe 74 extends upward. On the other hand, as shown in FIG. 6, which is a plan view of the branching portion 77 as viewed in a direction indicated by an arrow VI in FIG. 5, the branch pipe portion 76 is branched, at the branching portion 77, leftward from the main pipe portion 75 perpendicular to the valve shaft 80*b* of the exhaust control valve 80 which is directed in a vertical direction.

As shown in FIG. 6, the valve plate 80*a*, which rotates together with the valve shaft 80*b* about the valve shaft 80*b* at the branching portion 77, is directed parallel to the direction of the center line M of the main pipe portion 75 in the fully-open state A. When the exhaust control valve 80 is closed, a downstream-side valve plate section 80*ab* is brought into contact with the inner peripheral surface 75*a* of the main pipe portion 75 on a downstream-side edge of a branch opening 77*a* of the branch pipe portion 76, and an upstream-side valve plate section 80*aa* is brought into contact with the inner peripheral surface 75*a* of the main pipe portion 75 disposed on a side opposite to the branch opening 77*a* of the branch pipe portion 76.

With such a configuration, on the inner peripheral surface 75*a* of the main pipe portion 75, an upstream-side protruding portion 75*aa* is formed along the inner peripheral surface 75*a* at a rotational limit of the downstream-side valve plate section 80*ab* in a closing direction. The upstream-side protruding portion 75*aa* is brought into contact with an outer peripheral edge 81*b* of the downstream-side valve plate section 80*ab*, at an upstream side of the outer peripheral edge 81*b*. Further, on the inner peripheral surface 75*a* of the main pipe portion 75, a downstream-side protruding portion 75*ab* is formed at a rotational limit of the upstream-side valve plate section 80*aa* in a closing direction. The downstream-side protruding portion 75*ab* is brought into contact with an outer peripheral edge 81*a* of the upstream-side valve plate section 80*aa* at a downstream side of the outer peripheral edge 81*a*.

Accordingly, in the fully-closed state B of the main pipe portion 75, the upstream-side protruding portion 75*aa* and the outer peripheral edge 81*b* of the downstream-side valve plate section 80*ab* are brought into contact with each other, while the downstream-side protruding portion 75*ab* and the outer peripheral edge 81*a* of the upstream-side valve plate section 80*aa* are brought into contact with each other. As a result, the entire circumferential edge of the valve plate 80*a* is brought into contact with the protruding portions 75*aa* and 75*ab* of the inner peripheral surface 75*a* of the main pipe portion 75, thus improving sealing property of the main pipe portion 75.

Figure 7:
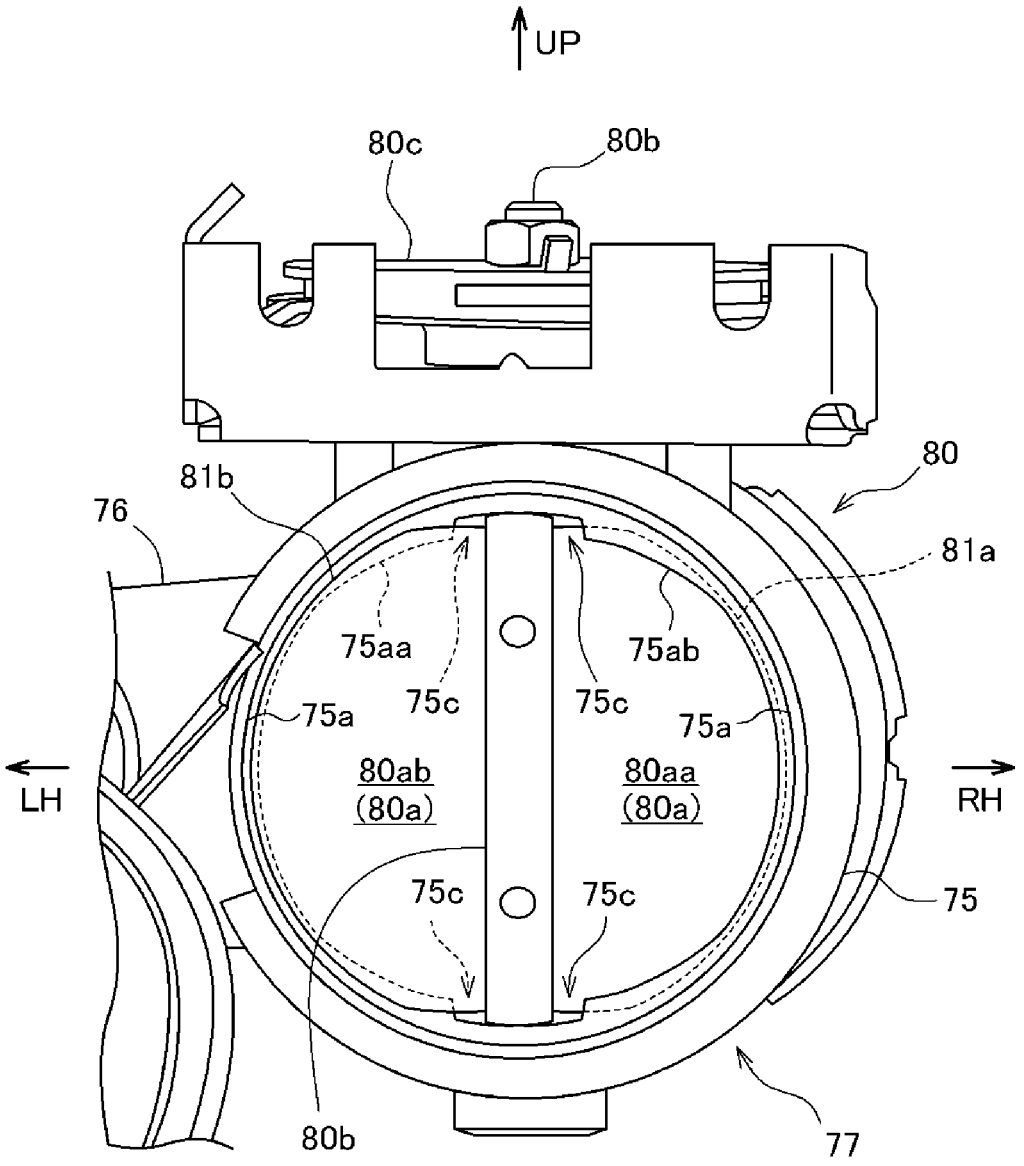
FIG. 7 is a transverse cross-sectional view of a main pipe portion as viewed in a direction indicated by arrows VII-VII in FIG. 6.

Reference is made to FIG. 7, which is a transverse cross-sectional view of the main pipe portion 75 as viewed in a direction indicated by arrows VII-VII in FIG. 6. On the inner peripheral surface 75*a* of the main pipe portion 75, the upstream-side protruding portion 75*aa* and the downstream-side protruding portion 75*ab* are formed, with which the outer peripheral edges 81*b* and 81*a* are respectively brought into contact at the rotational limits of the downstream-side valve plate section 80*ab* and the upstream-side valve plate section 80*aa* in the closing direction. Further, cutout portions 75*c* and 75*c* are formed in the upstream-side protruding portion 75*aa* and the downstream-side protruding portion 75*ab*, respectively, in areas around the outer periphery of the valve shaft 8*b*.

With such a configuration, it is possible to prevent the interference of the upstream-side protruding portion 75*aa* and the downstream-side protruding portion 75*ab* with the valve shaft 80*b*, which may be caused by thermal expansion of the upstream-side protruding portion 75*aa* or the downstream-side protruding portion 75*ab*.

As described previously with reference to FIG. 6, with respect to the valve plate 80*a*, the downstream-side valve plate section 80*ab*, which is directed toward a downstream side with respect to the center line M of the main pipe portion 75 in the fully-open state A, is rotated in a clockwise direction as viewed in FIG. 6, and is brought into contact with the upstream-side protruding portion 75*aa* disposed adjacent to a downstream-side edge 77*ab* (FIG. 8) of the branch opening 77*a* of the branch pipe portion 76 in the main pipe portion 75. At the same time, the upstream-side valve plate section 80*aa* is also rotated in the clockwise direction as viewed in FIG. 6, and is brought into contact with the downstream-side protruding portion 75*ab*. Accordingly, the main pipe portion 75 is brought into the fully-closed state B.

As described above, in the fully-closed state B, the downstream-side valve plate section 80*ab* which has been rotated from the fully-open state A is brought into contact with the upstream-side protruding portion 75*aa*, which is a portion disposed adjacent to the downstream-side edge 77*ab* of the branch opening 77*a*, from a downstream side of the main pipe portion 75. On the other hand, the upstream-side valve plate section 80*aa* is also brought into contact with the downstream-side protruding portion 75*ab*. As a result, the valve plate 80*a* can bring the main pipe portion 75 into the fully-closed state B at a rotational angle $\alpha$ which is less than 90° from the fully-open state A where the valve plate 80*a* extends along the center line M of the main pipe portion 75.

Further, exhaust gas which flows from an upstream side of the main pipe portion 75 can be introduced into the branch pipe portion 76 at a branch angle $\mu$ which makes an obtuse angle with respect to the center line M of the main pipe portion 75 due to the valve plate 80*a* formed of the upstream-side valve plate 80*aa* and the downstream-side valve plate 80*ab*. Accordingly, flow resistance of exhaust gas at the branching portion 77 can be suppressed.

Figure 8:
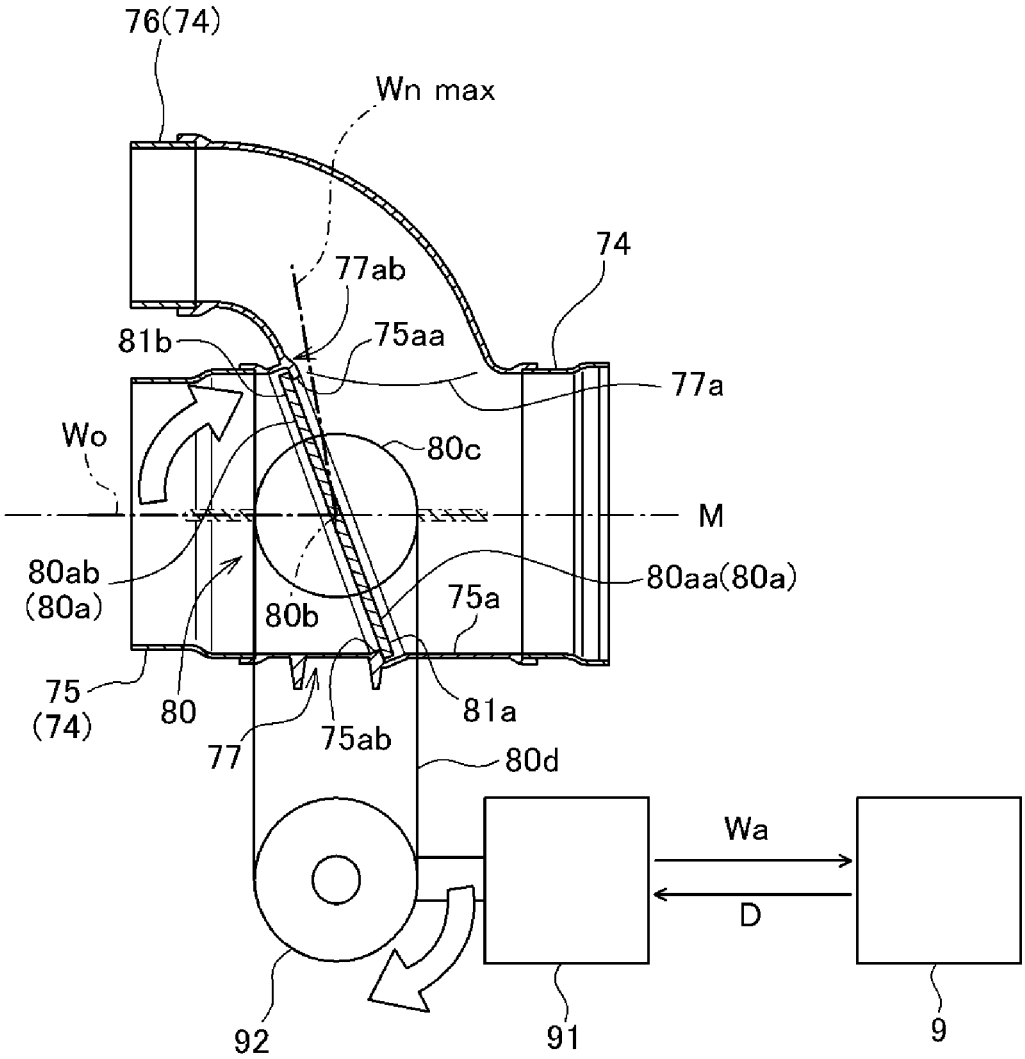
FIG. 8 is an explanatory view showing a schematically illustrated control system of an exhaust control valve and further showing in section the branching portion, as viewed substantially in the same direction as FIG. 6.

FIG. 8 is an explanatory view as viewed substantially in the same direction as FIG. 6. FIG. 8 additionally and schematically shows a control system for the exhaust control valve 80, in addition to the sectional view of the branch portion 77 of the downstream-side exhaust pipe 74.

The exhaust control valve 80 is configured such that the valve rotational drive portion 80*c* formed of the driven pulley mounted on the valve shaft 80*b* is operated in an interlocking manner with a drive pulley 92 which is driven by the drive motor 91 by way of the drive wire 80*d*. With such a configuration, the valve plate 80*a* is rotated. ここから

With a motor rotational angle signal Wo in the fully-open state A set to 0°, the drive motor 91 constantly transmits an actual motor rotational angle signal Wa to the engine control unit 9. The actual motor rotational angle signal Wa is linked with an actual rotating angle Va of the valve plate 80*a* in the closing direction. At the same time, a motor duty ratio D for acquiring a predetermined rotation of the valve plate 80*a* is instructed from the engine control unit 9 to the drive motor 91.

FIG. 8 is an explanatory view, as viewed substantially in the same direction as FIG. 6, with the control system of the exhaust control valve 80 schematically added to the view of the branching portion 77 of the downstream-side exhaust pipe 74.

Although a motor rotational angle signal W is linked with a rotational angle of the valve rotational drive portion 80*c* of the exhaust control valve 80, the motor rotational angle signal W takes an angular value which differs from a rotational angle of the valve rotational drive portion 80*c* due to a transmission ratio in the path between the drive motor 91 and the valve rotational drive portion 80*c*.

Assuming a case where an actual rotational angle Vo of the valve plate 80*a* in the fully-open state A is set to 0° (Vo=0°) and a nominal operational angle Vn in design when the valve plate 80*a* is in the fully-closed state B is set to α (Vn=α, α being less than 90° as described previously), a nominal motor operational angle Wn (see FIG. 9) of the motor rotational angle signal W, which is linked with the nominal operational angle Vn of the valve plate 80*a* in a fully-closed state, is 121.4°, for example, in this embodiment.

To set a nominal motor operational angle Wn by taking into account various tolerances, for example, an angular range of approximately ±12.5° can be taken. Mor specifically, the nominal motor operational angle on a maximum side Wn max (=approximately) 135° is set to be a "target closing rotational angle Wn max" of the motor rotational angle signal W, and a range (Wn max−Wn min) between the nominal motor operational angle on a maximum side Wn max (=approximately 135°) and the nominal motor operational angle on a minimum side Wn min (=approximately 110°) is determined as a range in which it is detected whether the valve plate 80*a* is brought into contact with the protruding portions 75*aa* and 75*ab* of the inner peripheral surface 75*a* of the main pipe portion 75 so that the valve plate 80*a* is brought into the fully-closed state B. That is, the range (Wn max−Wn min) between the nominal motor operational angle on the maximum side Wn max (=approximately 135° and the nominal motor operational angle on the minimum side Wn min (=approximately 110°) is determined as a "fully-closed state detecting range Wclose" of the motor rotational angle signal W.

An irregularity or scattering allowable range Wov to be used at the time of adjusting a fully-closed position is set to)±3.6° (Wov=±3.6°, for example, in connection with a motor rotational angle signal Wo when the valve plate 80*a* is in the fully-open state A)(Wo=0°.

A stopper position used at the time of performing an operation of returning the valve plate 80*a* to the fully-open state A is set to a position where a motor rotational angle signal Ws is −26°, for example.

To detect an unexpected trouble state such as biting of a stone into the exhaust control valve 80, for example, the following measure is adopted. In a period in which the valve plate 80*a* is brought into the predetermined fully-closed state from the fully-open state A, a range is set between the motor rotational angle signal Wo (=0°) and the motor rotational angle signal Wn min (=approximately 110°), which range is a "locking detection range Wlock".

Figure 9:
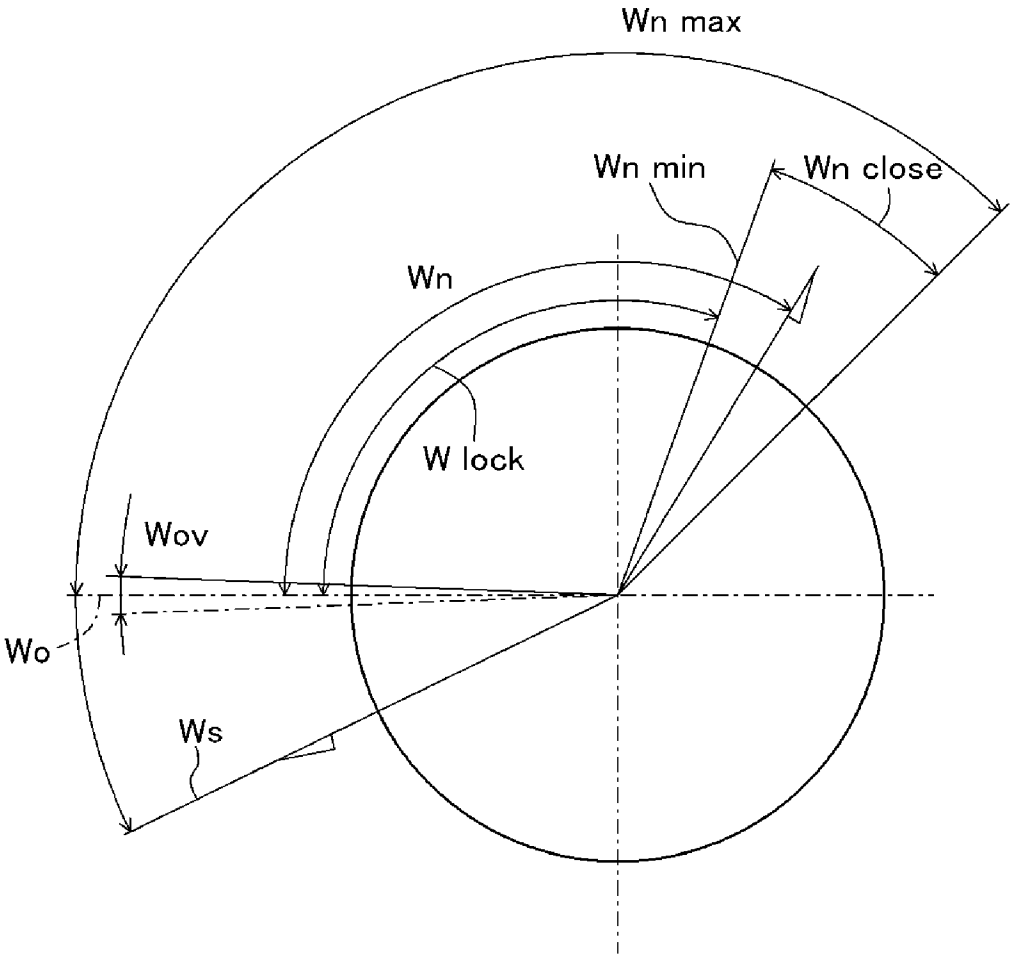
FIG. 9 is a chart of a motor rotational angle signal W while assuming the motor rotational angle signal W when a valve plate is in a fully-open state as 0°.
Figure 10:
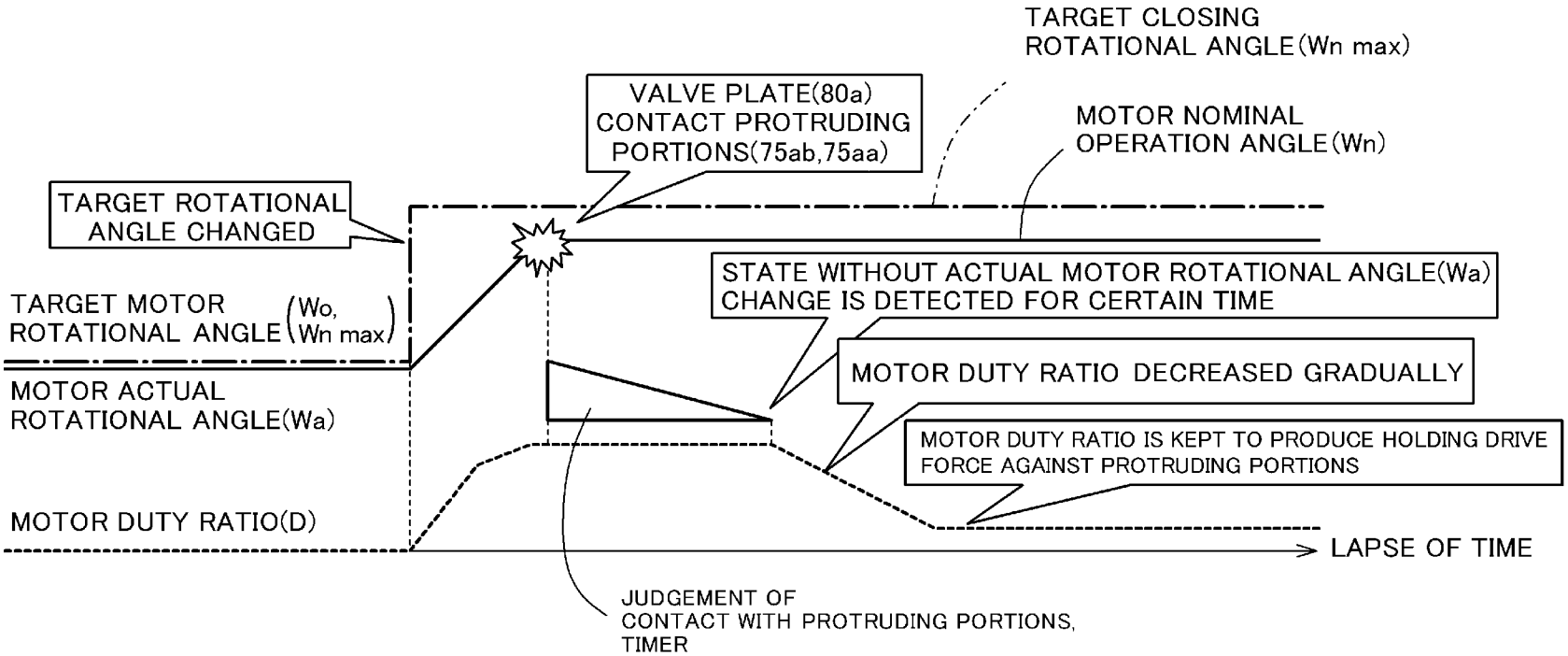
FIG. 10 is an explanatory diagram of drive motor control in accordance with the chart of the motor rotational angle signal W shown in FIG. 9.

FIG. 10 is an explanatory diagram of the drive motor control on the basis of the chart of the motor rotational angle signal W shown in FIG. 9.

During an operation of changing the valve plate 80*a* of the exhaust control valve 80 in the fully-open state A to the fully-closed state B, when the "target motor rotational angle" is changed from Wo to Wn max, the change is fed back as an increase in the "motor Duty ratio D" and the "actual motor rotational angle Wa" is increased.

The "closing target rotational angle Wn max" is set larger than the nominal motor operation angle Wn of the motor rotational angle signal W which is linked with the operational angle V of the valve plate 80*a* in the fully-closed state B for acquiring the fully-closed state B with certainty. Accordingly, the valve plate 80*a* impinges or abuts on the upstream-side protruding portion 75*aa* or the downstream-side protruding portion 75*ab* before the nominal motor operation angle Wn reaches the "closing target rotational angle Wn max" within the "full closing detection range Wclose" so that the increase of the "actual motor rotational angle Wa" is stopped.

When a state where there is no change in "actual motor rotational angle Wa" within the "full closing detection range Wclose" is detected for a predetermined time by a timer, the engine control unit 9 determines that the valve plate 80*a* impinges or abuts on the upstream-side protruding portion 75*aa* or the downstream-side protruding portion 75*ab*. As a result, the fully-closed state B is determined to be reached, and the "motor Duty ratio D" is gradually decreased so that "motor Duty ratio D" necessary for maintaining the fully-closed state B is maintained.

In returning the valve plate 80*a* to the fully-open state A, "motor Duty ratio D" is applied to the drive motor 91 in a reverse direction.

Further, in a case that a state where there is no change in "actual motor rotational angle Wa" even when "motor Duty ratio D" is increased within the range from the fully-open state A to the "locking detection range Wlock" is detected for a predetermined time by a timer, it is determined that a trouble such as biting of a stone into the exhaust control valve 80 has occurred. In this case, emergency processing is performed by immediately decreasing the "motor Duty ratio D".

In the exhaust control valve 80 of the motorcycle 1 according to this embodiment, the drive motor 91 of the exhaust control valve 80 is controlled as described above. Accordingly, the engine control unit 9 of the drive motor 91 for driving the valve rotational drive portion 80*c* is configured such that, in a state where the valve plate 80*a* is brought into contact with the upstream-side protruding portion 75*aa* or the downstream-side protruding portion 75*ab*, a motor duty ratio D is kept so that a certain holding drive force is generated in a direction for closing the exhaust control valve 80.

Accordingly, a state is maintained such that the outer peripheral edges 81*a* and 81*b* of the valve plate 80*a* are brought into contact with the upstream-side and downstream-side protruding portions 75*aa* and 75*ab* while a certain holding drive force is maintained, and hence the fully-closed state B of the exhaust control valve 80 can be maintained with certainty.

Further, the full closing detection range Wnclose is provided corresponding to the actual motor rotational angle Wa in the fully-closed state B of the valve plate 80*a* of the exhaust control valve 80. The engine control unit 9 is configured such that the motor duty ratio D is changed so as to change the drive force of the exhaust control valve 80 to a predetermined holding drive force in a case where the actual motor rotational angle Wa is not shifted even when the motor duty ratio D of a predetermined value or more is generated in driving the valve plate 80*a* within the full closing detection range Wnclose.

Accordingly, the fully-closed state B is determined only within the full closing detection range Wnclose corresponding to the actual motor rotational angle Wa in the fully-closed state B, and it is possible to avoid erroneous determination where biting of a foreign substance in the other regions or the like is determined as the fully-closed state D.

The actual motor rotational angle Wa on a valve full open side of the full closing detection range Wnclose is set as the locking detection range Wlock. The engine control unit 9 is configured such that driving of the exhaust control valve 80 is stopped in a case where the actual motor rotational angle Wa is not shifted even when the increase of the motor duty ratio D of a predetermined value or more is generated in driving the valve plate 80*a* within the lock detection range Wlock.

Accordingly, in a case where the actual motor rotational angle Wa is not shifted even when the increase of the motor duty ratio D of a predetermined value or more is generated within the lock detection range Wlock in the midst of closing the exhaust control valve 80, it is determined that abnormality exemplified by biting of a foreign substance such as a stone has occurred. Accordingly, driving of the exhaust control valve 80 is stopped, and hence the drive motor 91 and so on can be protected.

Although one embodiment of the present invention has been described heretofore, the present invention is not limited to the above-described embodiment, and various modifications are conceivable without departing from the gist of the present invention. For example, the application of the power unit and the internal combustion engine of the present invention is not limited to the two-wheel motorcycle, and the power unit and the internal combustion engine are also widely applicable to other types of saddle-riding vehicles.

For the sake of convenience of the description, with respect to the arrangement of the devices in the lateral direction, the description has been made in accordance with the illustrated embodiment. However, the present invention is not limited to such an arrangement, and the arrangement may be reversed in the lateral direction.

REFERENCE SINGS LIST

1 . . . motorcycle
2 . . . body frame
3 . . . power unit
4 . . . internal combustion engine
7 . . . exhaust pipe
9 . . . engine control unit (ECU)
14 . . . swing arm
15 . . . rear wheel
16 . . . rear suspension
19 . . . rear suspension link
21 . . . main frame
21*a* . . . center frame portion
22 . . . down frame
24 . . . pivot shaft
40 . . . crankcase
41 . . . crankshaft
43 . . . cylinder head
70 . . . exhaust muffler
71 . . . upstream-side exhaust pipe
73 . . . catalyst built-in pipe
74 . . . downstream-side exhaust pipe
74*a* . . . upstream end
75 . . . main pipe portion
75*a* . . . inner peripheral surface
75*aa* . . . upstream-side protruding portion
75*ab* . . . downstream-side protruding portion
75*c* . . . cutout portion
76 . . . branch pipe portion
77 . . . branching portion
77*a* . . . branch opening
77*ab* . . . downstream-side edge
80 . . . exhaust control valve
80*a* . . . valve plate
80*aa* . . . upstream-side valve plate section
80*ab* . . . downstream-side valve plate section
80*b* . . . valve shaft
80*c* . . . valve rotational drive portion
80*d* . . . drive wire
81*a* . . . outer peripheral edge of upstream-side valve plate section 80*aa*
81*b* . . . outer peripheral edge of downstream-side valve plate section 80*ab*
91 . . . drive motor
92 . . . drive pulley
A . . . fully-open state
B . . . fully-closed state
M . . . center axis of main pipe portion 75
W . . . motor rotational angle signal
Wa . . . actual motor rotational angle signal
Wo . . . motor rotational angle signal in full-open A state
Wn . . . nominal motor operational angle
Wnmax . . . closing target rotational angle
Wnclose . . . full closing detection range (Wnmax-Wnmin)
Wov . . . irregularity allowable range of Wo
Ws . . . motor rotational angle signal at stopper position
Wlock . . . locking detection range
Wa . . . actual motor rotational angle
D . . . motor Duty ratio
Va . . . actual rotational angle of valve plate 80*a* in closing direction
Vo . . . rotational angle of valve plate 80*a* in fully-open state A
Vn . . . nominal operational angle of valve plate 80*a* in fully-closed state B in design

The invention claimed is:

1. An exhaust control valve of a saddle-riding vehicle in which an engine exhaust pipe of the saddle-riding vehicle has a main pipe portion and a branch pipe portion which are connected to an exhaust muffler at a downstream side, and a branching portion, where the branch pipe portion is branched sideward from the main pipe portion, the exhaust control valve being provided to perform a full-open to full-closed control of the main pipe portion at a downstream side of the branching portion, the exhaust control valve comprising:

a valve shaft disposed in the main pipe portion, at a position facing a branch opening of the branch pipe portion, to extend in a manner intersecting a center axis of the main pipe portion;

a valve plate mounted on the valve shaft to be rotatable about the valve shaft in and along an inner peripheral surface of the main pipe portion;

a valve rotational drive portion mounted on one end of the valve shaft, penetrating the inner peripheral surface of the main pipe portion;

a drive motor for driving the valve rotational drive portion; and a control unit for controlling the drive motor, wherein protruding portions are provided on an inner peripheral surface of the main pipe portion, the protruding portions being formed so as to be brought into contact with outer peripheral edges of the valve plate at a rotational limit of the valve plate of the exhaust control valve in a closing direction.

2. The exhaust control valve of a saddle-riding vehicle as claimed in claim 1, wherein the protruding portions have respective cutout portions in areas around the valve shaft.

3. The exhaust control valve of a saddle-riding vehicle as claimed in claim 2, wherein the protruding portions include an upstream-side protruding portion formed so as to be disposed adjacent to a downstream-side edge of the branch opening of the branch pipe portion, the valve plate has a downstream-side valve plate section directed, in a fully-open state, in a downstream direction of the center line of the main pipe portion with respect to the valve shaft, and the valve plate is rotatable from a downstream side of the center axis into a fully-closed state, where the downstream-side valve plate is in contact with the upstream-side protruding portion at a valve angle of less than 90°.

4. The exhaust control valve of a saddle-riding vehicle as claimed in claim 1, wherein the protruding portions include an upstream-side protruding portion formed so as to be disposed adjacent to a downstream-side edge of the branch opening of the branch pipe portion, the valve plate has a downstream-side valve plate section directed, in a fully-open state, in a downstream direction of the center line of the main pipe portion with respect to the valve shaft, and the valve plate is rotatable from a downstream side of the center axis into a fully-closed state, where the downstream-side valve plate is in contact with the upstream-side protruding portion at a valve angle of less than 90°.

5. The exhaust control valve of a saddle-riding vehicle as claimed in claim 4, wherein, in a state where the outer peripheral edges of the valve plate are brought into contact with the protruding portions, the control unit of the drive motor for driving the valve rotational drive portion is configured to hold a motor duty ratio in which a predetermined holding drive force is generated in a direction in which the exhaust control valve is closed.

6. The exhaust control valve of a saddle-riding vehicle as claimed in claim 5, wherein a full closing detection range is provided in connection with an actual motor rotational angle in the fully-closed state of the valve plate of the exhaust control valve, and the control unit is configured to change the motor duty ratio so as to change a drive force of the exhaust control valve to said predetermined holding drive force in a case where the motor actual rotational angle is not shifted even when the motor duty ratio of a predetermined value or more is generated in driving the valve plate within the full closing detection range.

7. The exhaust control valve of a saddle-riding vehicle as claimed in claim 6, wherein the actual motor rotational angle on a valve full open side of the full closed detection range is set as a locking detection range, and the control unit is configured to stop driving of the exhaust control valve in a case where the actual motor rotational angle is not shifted even when an increase of the motor duty ratio of a predetermined value or more is generated in driving the valve plate within the lock detection range.

8. The exhaust control valve of a saddle-riding vehicle as claimed in claim 5, wherein the actual motor rotational angle on a valve full open side of the full closed detection range is set as a locking detection range, and the control unit is configured to stop driving of the exhaust control valve in a case where the actual motor rotational angle is not shifted even when an increase of the motor duty ratio of a predetermined value or more is generated in driving the valve plate within the lock detection range.

9. The exhaust control valve of a saddle-riding vehicle as claimed in claim 4, wherein the actual motor rotational angle on a valve full open side of the full closed detection range is set as a locking detection range, and the control unit is configured to stop driving of the exhaust control valve in a case where the actual motor rotational angle is not shifted even when an increase of the motor duty ratio of a predetermined value or more is generated in driving the valve plate within the lock detection range.

* * * * *